US011994361B2

(12) United States Patent
Pushkarev

(10) Patent No.: US 11,994,361 B2
(45) Date of Patent: May 28, 2024

(54) ADJUSTABLE SWIVEL CHEEK PIECE BUTTSTOCK

(71) Applicant: Nikolai Pushkarev, Irkutsk (RU)

(72) Inventor: Nikolai Pushkarev, Irkutsk (RU)

(73) Assignee: Nikolai Pushkarev, Irkutsk (RU)

( * ) Notice: Subject to any disclaimer, the term of this patent is extended or adjusted under 35 U.S.C. 154(b) by 22 days.

(21) Appl. No.: 17/718,388

(22) Filed: Apr. 12, 2022

(65) Prior Publication Data

US 2022/0333896 A1 Oct. 20, 2022

(51) Int. Cl.
*F41C 23/14* (2006.01)

(52) U.S. Cl.
CPC ..... *F41C 23/14* (2013.01)

(58) Field of Classification Search
CPC ..... F41C 23/04; F41C 23/20; F41C 23/14; F41A 11/04
USPC ..... 42/75.03, 73, 71.01
See application file for complete search history.

(56) References Cited

U.S. PATENT DOCUMENTS 4,060,067 A * 11/1977 Dandine ..... F41B 7/046 124/31
8,087,193 B2 * 1/2012 Kincel ..... F41C 23/14 42/74
8,381,427 B2 2/2013 Nill
9,488,435 B1 * 11/2016 Roberts ..... F41C 23/14
9,523,552 B2 * 12/2016 Eitan ..... F16B 37/122
2005/0268516 A1 * 12/2005 Nelson ..... F41G 1/00 42/73
2006/0174532 A1 * 8/2006 Popikow ..... F41C 23/20 42/73
2015/0338186 A1 * 11/2015 Hopkins ..... F41C 23/04 42/73
2016/0084612 A1 * 3/2016 Robinson ..... F41C 23/14 42/73
2020/0182586 A1 * 6/2020 Zhang ..... F41C 23/20

FOREIGN PATENT DOCUMENTS

RU 127886 U 12/2012
RU 2712485 1/2020
RU 201091 U 11/2020

* cited by examiner

*Primary Examiner* — Michael D David
(74) *Attorney, Agent, or Firm* — Yefim Kreydin

(57) ABSTRACT

There is an axle (2) installed in the buttstock body. One end of the axle (2) is connected to the first end of the spring and the second end of the spring is fixed to the swivel platform. The swivel platform is being centered by means of one axle, the spring energy is transferred directly from the axle to the swivel platform. This makes possible to simplify the trigger mechanism of the swivel platform rotation and to increase the performance reliability.

1 Claim, 3 Drawing Sheets

ADJUSTABLE SWIVEL CHEEK PIECE BUTTSTOCK

This application is the United States application which claims the benefit of Russian Patent application No RU 2021110325 FILED Apr. 14, 2021, the entire disclosure of which is incorporated herein by reference.

The invention relates to firearms, in particular to small arms with a buttstock, and is aimed at extending their functionality.

DESCRIPTION OF THE PRIOR ART

There is a wide variety of buttstock designs developed for small arms, providing shooters with comfort when shooting, fitting to their different anthropological characteristics, since the available buttstock designs are aimed at people of average build.

The closest designs is RU201091U1 "Small arms stock with adjustable pivoting cheek piece", including the body, swivel platform with the cheek piece mounted on it, and platform position retainer. The swivel platform has a driven gear that interacts with a spring-loaded drive gear mounted between two bases in the buttstock body. In the base of the stock body there is a spring-loaded link that interacts with the trigger button located at the front of the stock body and interacts with the pivot platform to quickly change the cheek piece position.

The disadvantage of this buttstock model is the complexity of design, a large number of parts, and consequently lower reliability.

SUMMARY OF THE INVENTION

The new technical result represents a simplification of the buttstock design and an increase in its reliability.

The technical result is achieved by the construction of the buttstock with adjustable swivel cheek piece, incorporating a body with a spring-loaded link in the base, which interacts with the trigger button located in the front part of the body, interfaced with the swivel platform with the cheek piece mounted on it, a platform position lock, and a torsion spring; the buttstock is additionally fitted with an axle which is attached to one end of the torsion spring, while its other end is fixed to the swivel platform. The amount of parts in the proposed model is significantly reduced, the spring energy is transferred not from the driving pinion to the driven one and then to the swivel platform, as in the prototype (no such parts are present in the proposed model), but instead directly from the axle to the swivel platform. This increases the reliability of the mechanism.

The removable, adjustable swivel cheek piece is designed to rotate freely and lock in offset positions against the firearm's buttstock. This makes it possible to move the cheek piece vertically and adjust the buttstock to the shooter's anthropometric characteristics, which in turn makes it possible to instantly change the position of the head on the buttstock cheek piece by automatically rotating it, thereby making a quick transition of aiming through the primary sight to a sector sight.

BRIEF DESCRIPTION OF THE DRAWINGS

The essence of the invention is explained by the following figures.

DESCRIPTION OF THE PREFERRED EMBODIMENT

Figure 1:
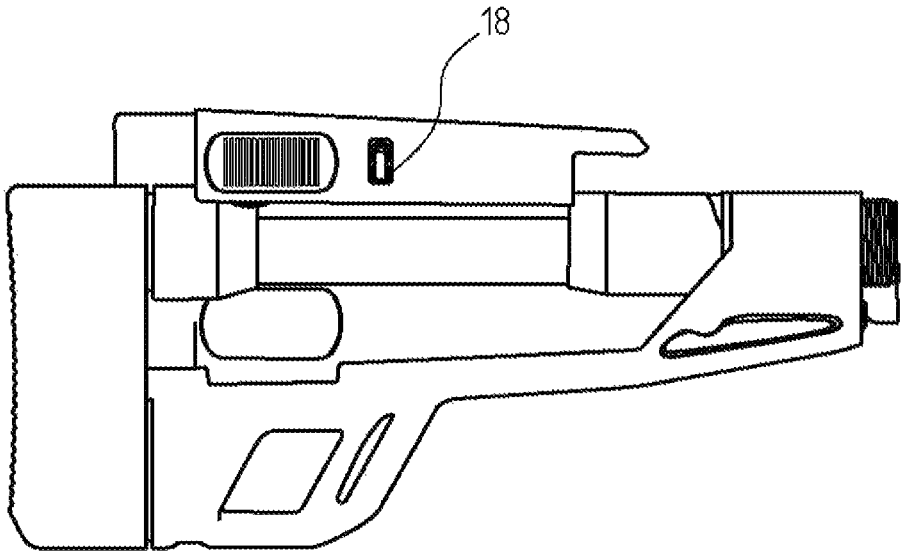
FIG. 1 shows a general view of the small arms buttstock with an adjustable cheek piece, cheek raised.

Detailed description in static.

The buttstock with an adjustable cheek piece contains a body 1 (FIG. 3) with an axle 2 installed in it, a swivel platform 3, a butt plate 4, and an adjustable swivel cheek piece 5. The stock body 1 has a window 6 and a cutout 7 in the front part of the stock. In the rear part of the axle 2 a hexagon 9 is provided for one end of the spring 8, and for the other end—a recess 10 in the swivel platform 3.

Figure 3:
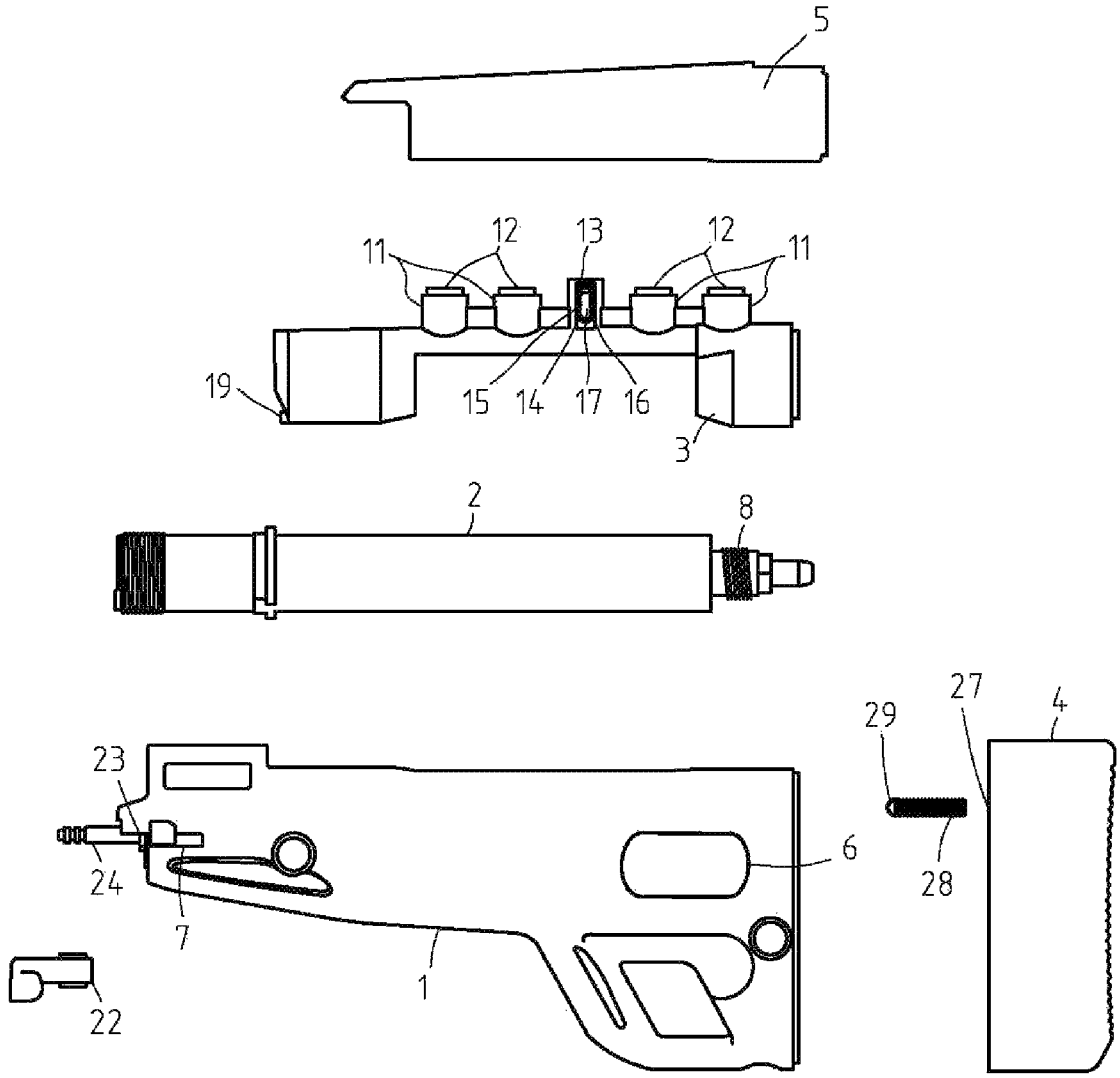
FIG. 3 shows an exploded view of the buttstock.
Figure 4:
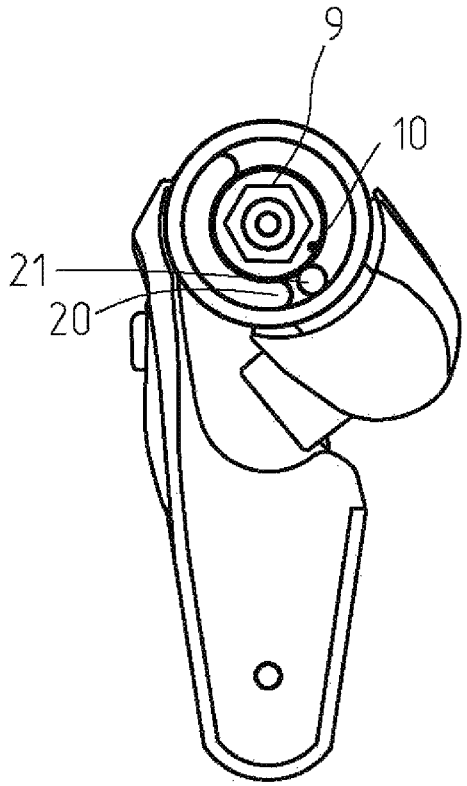
FIG. 4 shows the position of the cheek piece during the transition for firing through the sector sights.

In the upper part of the swivel platform 3 there are four cylinders 11 to accommodate the shock-absorbing springs 12, the cylinders 11 act as guides. Between the cylinders there is a device 13 in the form of a guiding rod in which there are cutouts 14 and 15 for the bolt head 16 and nut 17, which is used for mounting the cheek 5 to the platform 3. The cheek 5 is held by the bolt head 16 and edge of the cutout 18 (FIG. 1). In the front part of the platform 3 there is a cutout 19, and in the rear part there is a recess for the retainer 20 and 21 (FIG. 3). To control the platform rotation, the trigger mechanism is installed in the body 1, which includes the release button 22, connected to the rod by the detent 23 and the pullback spring 24. The butt plate 4 is secured to the body 1 by a bolt 25 and to the axle by a bolt 26. A recess 27 is provided in butt plate 4 for spring 28 and retainer ball 29.

Description of the buttstock in operation.

Figure 2:
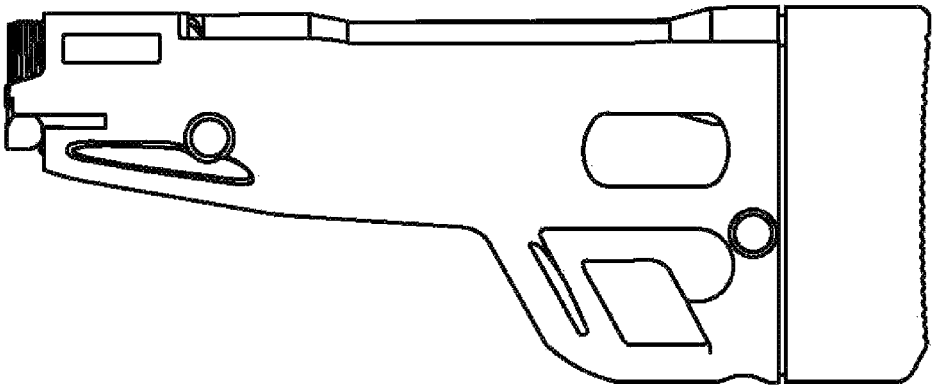
FIG. 2 shows a general view of small arms buttstock with adjustable cheek piece, cheek lowered.

Operating the removable adjustable buttstock swivel cheek piece is carried out as follows. Move the cheek to the position shown in FIG. 1 through the window 6 using the thumb, if it is planned to use the gun with the primary sight. Then, adjust the height of the cheek 5 by pressing on its upper part, slightly compressing the springs 12, and loosen the bolt 16 with an Allen wrench until the nut 17 comes out of the cutout. Then, using a hex key 9, as it is inserted into the head of the bolt 16, move the bolt 16 up or down, while pressing or releasing the cheek 5. After the cheek 5 has reached the desired position, the bolt is tightened with a wrench. The cheek will be in the desired position. The shooter's line of sight will be aligned with the line of primary sight. In the event of shooting conditions change, following with the necessity to change the cheek 5 position, one must, without taking the hand off the fire control handle, press the release button 22 with the right hand thumb, the locking rod will disconnect from the cutout 19 of the rotary platform 3, the released energy of the spring 8, as it is fixed at one end to the axle and held by the hex nut 9, and the other is fixed in the depression 10 (FIG. 3) of the swivel platform 3, will be transferred to the swivel platform 3. The cheek 5 will change its position by rotating to the desired angle and will be held in the desired position by the retainer ball 29 and spring 28 in the recess 20 in the swivel platform 3 (FIG. 3). The shooter's head will change its position and the line of the sector sight will align with the shooter's line of sight. To move the cheek to the lower position, turn the swivel platform 3 to the position shown on FIG. 2 by applying a minimal force, the retainer ball 29 will move into the recess 21.

The invention claimed is:

1. Adjustable cheek piece buttstock, incorporating a body with a trigger button in the front and a spring-loaded link in the base, a swivel platform with a cheek mounted on it and a platform locking device, and a spring; the device is distinguished by the design of the buttstock body, where there is an axle (2), which is connected to one end of the spring, and the second end of the spring is fixed to a swivel platform.

* * * * *